US006682360B2

(12) United States Patent
Schauer et al.

(10) Patent No.: US 6,682,360 B2
(45) Date of Patent: Jan. 27, 2004

(54) COUPLING ELEMENT FOR MOUNTING TO A SHIELDED ELECTRICAL CABLE AND METHOD FOR MOUNTING THE SAME TO A CABLE

(75) Inventors: Friedrich Schauer, Heroldsberg (DE); Martin Czeschka, Hilpolstein (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 10/212,052

(22) Filed: Aug. 6, 2002

(65) Prior Publication Data

US 2003/0045142 A1 Mar. 6, 2003

(30) Foreign Application Priority Data

Aug. 7, 2001 (DE) ..... 101 38 728

(51) Int. Cl.[7] ..... H01K 13/62
(52) U.S. Cl. ..... 439/323; 439/610
(58) Field of Search ..... 439/314–323, 439/610, 606

(56) References Cited

U.S. PATENT DOCUMENTS 2,949,642 A * 8/1960 Lieberman ..... 439/323
4,218,110 A * 8/1980 Giannaula ..... 439/323
4,673,234 A * 6/1987 Lewis ..... 439/323
5,226,837 A 7/1993 Cinibulk et al.
5,391,088 A 2/1995 Tomchak et al.
5,692,918 A * 12/1997 Hill ..... 439/323

FOREIGN PATENT DOCUMENTS

| | | | |
|---|---|---|---|
| DE | 3034415 | A1 | 10/1982 |
| DE | 19529692 | A1 | 2/1997 |
| DE | 29519589 | U1 | 5/1997 |
| DE | 19613228 | A1 | 10/1997 |
| EP | 0128472 | A2 | 12/1984 |

* cited by examiner

*Primary Examiner*—Gary Paumen
(74) *Attorney, Agent, or Firm*—Sughrue Mion, PLLC

(57) ABSTRACT

A coupling element (K) for mounting to a shielded electrical cable (1), and a method for mounting the it. The cable (1) has plural insulated electrical conductors, a surrounding metallic shield, and an outer insulating jacket. The shield is fixed to a sleeve-like metallic adapter into which conductors of the cable (1) project. The adapter is surrounded by an insulating protective part (2), and for removal of the coupling element the adapter has a hollow space that is free from the insulating material of the protective part (2). An internally-threaded metallic sleeve (7) is freely rotatable about its axis and is captively attached to the adapter at its end facing away from the cable (1) and encompasses the adapter. A connector body (8) having a threaded fitting and enclosing the contact carrier is screwed into the sleeve so that it abuts the adapter with a moisture-tight fit.

4 Claims, 2 Drawing Sheets

COUPLING ELEMENT FOR MOUNTING TO A SHIELDED ELECTRICAL CABLE AND METHOD FOR MOUNTING THE SAME TO A CABLE

This application is based on and claims the benefit of German Patent Application No. 10138728.8 filed Aug. 7, 2001, which is incorporated by reference herein.

BACKGROUND OF THE INVENTION

The invention relates to a coupling element for mounting to a shielded electrical cable comprising at least two insulated electrical conductors, a flexible metallic shield surrounding it, and a jacket made of an insulating material placed on top thereof. The shield is fixed to a sleeve-like metallic adapter into which project the insulated electrical conductors of the cable. Contact elements arranged in a contact carrier made of a mechanically stable insulating material are fixed to the conductors. The adapter is surrounded by a protective part made of an insulating material produced by injection molding and projecting over the cable while leaving free the adapter opening that faces away from the cable. The invention further relates to a method for mounting the coupling element to a cable, e.g., of the type described in German Patent Application DE 30 34 415 A1.

A coupling element in terms of the invention can be a connector or a socket. The associated contact elements can be configured as pins or as jacks. Shielded electrical cables are used, for instance, in portable radio equipment, as telephone lines, in spring cables for fixed electroacoustic systems, or in vehicles, ships, aircraft, and especially in railroads. The coupling elements should be moisture-tight per se. Their connection with the respective cable must also be moisture-tight. In addition, the shield of the cable must be connected to the coupling element without any gap.

In the prior-art coupling element disclosed in the above-mentioned document DE 30 34 415 A1, the cable-side end of a metallic adapter is embodied as an attachment whose radial dimensions are smaller than the dimensions of a grip section of the adapter on the connection side. A circumferential groove-like indentation is made in the attachment at a distance from its cable-side end. The attachment furthermore has at least one axially extending recess running from the cable-side end up to the indentation for receiving a tension member of the cable, which is guided up to and into the indentation. The attachment is moreover provided with a metallic sleeve that projects over the cable and firmly fits against the attachment. This sleeve also covers the shield of the cable connected to the attachment. A grip element made of an insulating material is injection-molded around the cable-side end of the basic body and the end of the cable. This coupling element is attached to the end of the cable such that it securely contacts the shield and is moisture-tight. However, it cannot be removed from the cable end without being destroyed. To correct any errors and to change the positions of the contact elements in the coupling part, said coupling part must therefore be newly mounted each time.

SUMMARY OF THE INVENTION

An object of the invention is to design the initially described coupling element and the associated method so that it can be detached, while maintaining its moisture-tight arrangement on the cable and the non-interrupted shielding.

According to the invention, this object is attained by the adapter being provided with a hollow space, which is free from the insulation material of the protective part and serves to receive reserve lengths of the conductors, and a metallic sleeve provided with an internal thread and freely rotatable about its axis being captively attached to the adapter at the adapter end facing away from the cable and encompassing said adapter, and a connector body equipped with a threaded fitting and encompassing the contact carrier being screwed into said sleeve so that it abuts the adapter with a moisture-tight fit.

The hollow space for receiving the reserve lengths of the conductors is produced by a cover, which encloses the conductors during injection molding of the protective part and which fits against the wall of the adapter.

The coupling element is made moisture-tight and is jointed to the cable by the protective part that is injection-molded around it. It can nevertheless be removed without risk of damage because the connector body can be detached from the adapter by means of the sleeve. The conductors of the cable, which are actually too long when the coupling element is assembled, are received as reserve lengths in the hollow space of the adapter where they are protected against damage. When the coupling element is opened, these reserve lengths of the conductors allow problem-free handling of the conductors with the contact elements attached thereto. The coupling element can therefore be opened at any time if required, making it possible, for instance, to change the positions of the contact elements in the contact carrier. For this purpose, only the metallic sleeve needs to be rotated so that the connector body is removed therefrom. The contact carrier is then ready for any type of manipulation. Thus, it is also possible to conduct measurements for troubleshooting. Subsequently, the connector body with the contact carrier is screwed back into the sleeve by rotating the sleeve. The contact carrier is not rotated to close or open the coupling element. It is only moved in an axial direction. Thus, the connected conductors are not twisted but are only pushed together in axial direction to form the reserve lengths or pulled apart again.

BRIEF DESCRIPTION OF THE DRAWINGS

An exemplary embodiment of the subject of the invention is depicted in the drawings, in which.

DETAILED DESCRIPTION OF THE INVENTION

Figure 1:
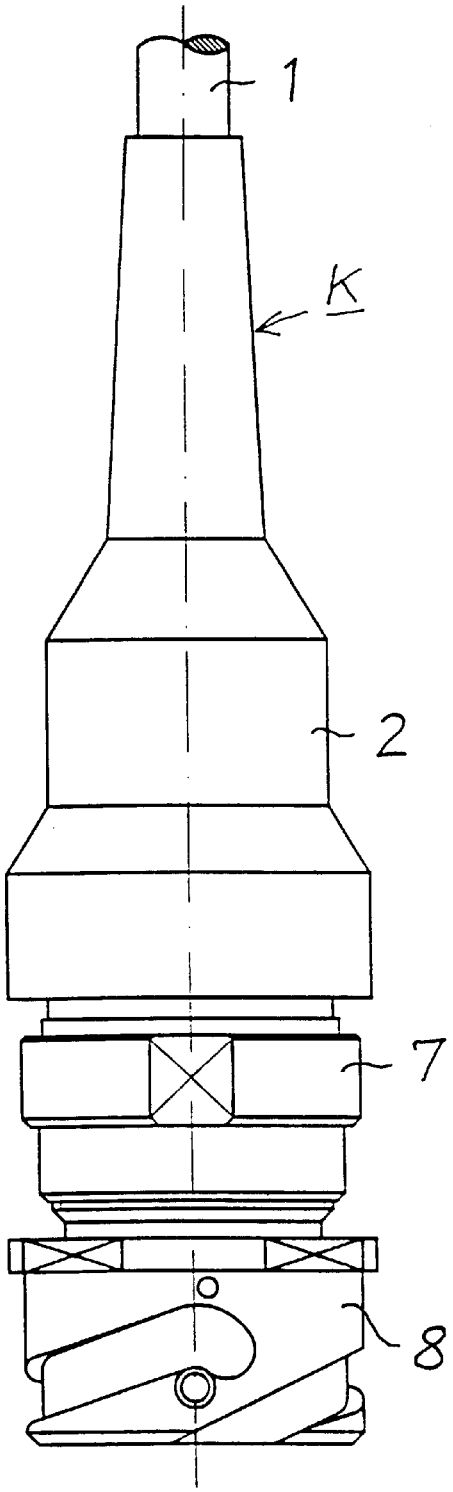
FIG. 1 shows a coupling element according to the invention.
Figure 2:
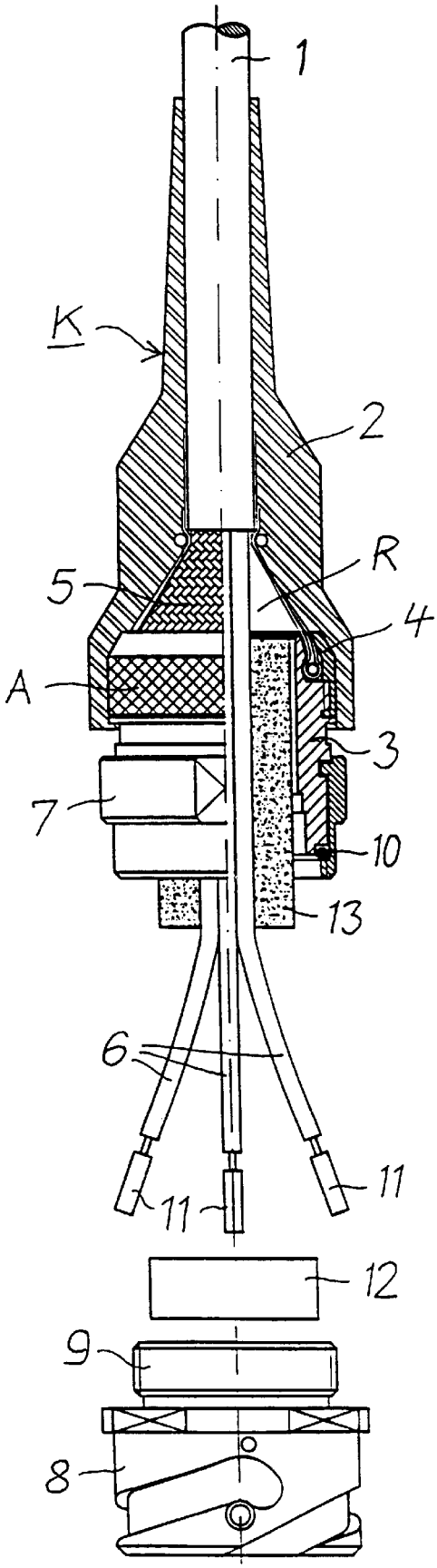
FIG. 2 shows the coupling element when it is partially disassembled.

The coupling element K shown in FIGS. 1 and 2 is mounted to the end of a shielded electrical cable 1. It has a protective part 2, which is produced by injection molding and which encloses cable 1 and a sleeve-like metallic adapter A in a partially moisture-tight manner. Adapter A comprises two parts 3 and 4 that can be screwed together. The flexible shield 5 of cable 1, which is made of copper wire braiding, is nipped between these to parts. Cable 1 has at least two insulated conductors 6 that are surrounded by the common shield 5. Preferably, cable 1 is equipped with a greater number of conductors 6. A jacket of an insulating material is placed over shield 5.

A metallic sleeve 7 is captively but freely rotatably mounted to the free end of adapter A facing away from cable 1. Sleeve 7 is provided with an internal thread. In the finished coupling element K shown in FIG. 1, a metallic connector body 8 is screwed into sleeve 7 by means of an associated threaded fitting 9. An annular seal 10, e.g., an O-ring lies between connector body 8 and adapter A. On the outside, connector body 8 can be provided with parts of a locking device, e.g., parts of a bayonet lock.

Contact elements 11 are fixed to the stripped ends of conductors 6 of cable 1, as shown in FIG. 2. In the finished coupling element K, these contact elements are inserted into a contact carrier 12, which is made of a mechanically stable plastic. In the finished coupling element K, the contact carrier 12 equipped with the contact elements 11 lies within the connector body 8. The contact elements 11 are then accessible for mating contacts of a connector or a device.

The coupling element K is mounted to the end of cable 1, e.g., as follows:

The cable jacket is stripped from the end of cable 1 over a sufficient length to make accessible shield 5 and conductors 6 that are enclosed thereby. Shield 5 is then shortened to free a relatively large length of conductors 6 and is widened, for instance, in the form of a rosette. Thereafter, conductors 6 are pushed through adapter A. The widened shield 5 is then nipped between parts 3 and 4 of adapter A such that the shield extends up to sleeve 7 without a gap.

Figure 3:
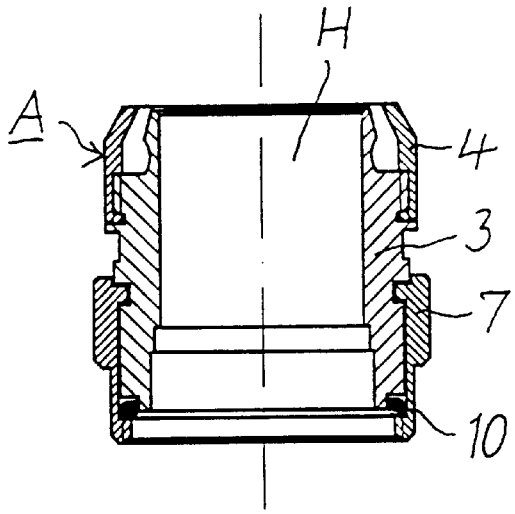
FIG. 3 is a cross section through an adapter pertaining to the coupling element with a sleeve.
Figure 4:
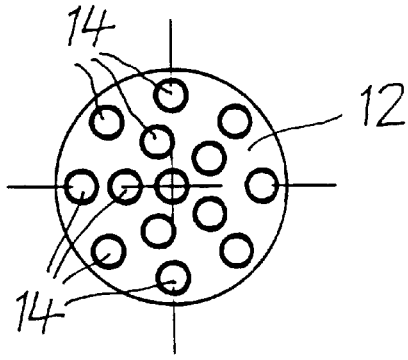
FIG. 4 is a top view of a contact carrier of the coupling element.

A tubular cover 13 is then pushed over conductors 6 of the cable end that has thus been prepared. It encloses conductors 6 as tightly as possible and fits against the wall of adapter A, here against part 3 of adapter A. The hollow space H of adapter A, which is visible in FIG. 3, is then almost completely filled by cover 13. In an injection mold, the protective part 2 is subsequently injection-molded around the end of cable 1 and the cable-side end of adapter A. Cover 13 ensures that the injection molding material does not penetrate into adapter A. Especially the adapter opening which faces away from cable 1 and sleeve 7 are thereby kept free from injection molding material. The opening of adapter A which faces cable 1 and through which conductors 6 are inserted into adapter A can also be scaled prior to injection molding of protective part 2. For this purpose a sealant, which can, for instance, be a two-component casting resin or a hot-melt adhesive, can be applied in area R (FIG. 2). After completion of the injection molding process, cover 13 is removed, leaving a hollow space H in which conductors 6 are located.

The insulation is then stripped from the ends of conductors 6. Thereafter, the contact elements 11 are conductively attached to conductors 6, e.g., by crimping. The contact elements 11 are then inserted into the through-holes 14 of contact carrier 12, e.g., in accordance with a predefined pattern. Both the conductors 6 or their contact elements 11 and the through-holes 14 can be marked or coded for this purpose. This allows an exact assignment of each conductor to a through-hole.

The connector body 8 with contact carrier 12 located therein is subsequently brought up to sleeve 7. Rotating sleeve 7 causes the connector body 8 together with contact carrier 12 to be pulled in the direction of adapter A. Conductors 6 are thereby pushed together in axial direction and are stored as reserve lengths in hollow space H of adapter A. In the final position, the connector body 8 with its threaded fitting 9 lies against seal 10. To prevent any unintended detachment of connector body 8 from sleeve 7, an adhesive may be applied to threaded fitting 9 prior to assembly.

To disassemble coupling element K, which may be necessary to change the positions of contact elements 11 in contact carrier 12, the adhesive is first softened from the outside by applying heat. Thereafter, the connector body 8 can be screwed from sleeve 7 by rotating sleeve 7. This causes the conductors 6 to be stretched out again from their previously pushed together position. The contact elements 11 can now be removed from contact carrier 12 to change the position of some or all of the contact elements 11 and can then be reinserted in a different position in the through-holes 14 of the contact carrier. The coupling element K is then reassembled as described above.

What is claimed is:

1. A coupling element for mounting to a shielded electrical cable comprising at least two insulated electrical conductors, a flexible metallic shield surrounding the same, and a jacket of insulating material placed on top thereof, wherein the shield is fixed to a sleeve-like metallic adapter into which project the insulated electrical conductors of the cable, wherein contact elements are attached to the conductors of the cable and are arranged in a contact carrier made of a mechanically stable insulation material, and wherein the adapter is surrounded by a protective part made of an insulating material which is produced by injection molding and projects over the cable while leaving free the adapter opening that faces away from the cable, wherein the adapter (A) has a hollow space (H) that is free from the insulating material of the protective part (2) to receive reserve lengths of the conductors (6) and a metallic sleeve (7) provided with an internal thread and freely rotatable about its axis is captively attached to the adapter (A) at the adapter end facing away from the cable (1) and encompasses said adapter, and a connector body (8) equipped with a threaded fitting (9) and encompassing the contact carrier (12) is screwed into said sleeve so that it abuts the adapter (A) with a moisture-tight fit.

2. A coupling element as claimed in claim 1, wherein an annular seal (10) is arranged between adapter (A) and connector body (8).

3. A coupling element as claimed in claim 1, wherein the sleeve (7) and connector body (8) are bonded together.

4. A coupling element as claimed in claim 1, wherein parts of a locking device are arranged on the outside of the connector body (8).

* * * * *